United States Patent [19]

Howell

[11] 3,992,973

[45] Nov. 23, 1976

[54] PULSE GENERATOR FOR AN ELECTRONIC MUSICAL INSTRUMENT

[75] Inventor: Stephen L. Howell, Jasper, Ind.

[73] Assignee: Kimball International, Inc., Jasper, Ind.

[22] Filed: Sept. 18, 1974

[21] Appl. No.: 507,228

[52] U.S. Cl. ..... 84/1.23; 84/DIG. 11; 307/208; 307/265; 328/58; 328/158

[51] Int. Cl.[2] ..... G10H 1/06; G10H 5/06

[58] Field of Search ..... 84/1.01, 1.03, 1.11, 84/1.19, 1.22, 1.23, DIG. 11; 307/208, 265, 291; 328/58, 63, 158, 206

[56] References Cited

UNITED STATES PATENTS

| | | | |
|---|---|---|---|
| 3,479,603 | 11/1969 | Overstreet, Jr. | 307/208 |
| 3,535,969 | 10/1970 | Bunger | 84/1.11 |
| 3,617,901 | 11/1971 | Franssen | 84/1.01 X |
| 3,767,834 | 10/1973 | Hebeisen et al. | 84/1.19 |

OTHER PUBLICATIONS

D. O. Pederson et al., Introduction to Electronic Systems, Circuits and Devices, McGraw-Hill Book Company, copyright 1966, p. 191.

Millman & Taube, Pulse, Digital, and Switching Waveforms, McGraw-Hill Book Company, copyright 1965, p. 312.

Morris et al., Designing with TTL Integrated Circuits, Texas Instruments Electronics Series, McGraw-Hill Book Company, copyright 1971, p. 166.

*Primary Examiner*—Stanley J. Witkowski

*Attorney, Agent, or Firm*—Melvin A. Crosby

[57] ABSTRACT

A pulse generator especially for an electronic musical instrument in which a "D" type flip-flop is employed with the logic level at the data input thereof being transferred to the output in conformity with the supply to the clock input of a fixed frequency rectangular wave and the supply to the clear input of a rectangular wave having a frequency which is a whole multiple of the fixed frequency. The output at the output terminal of the flip-flop is a pulse having a duty cycle of predetermined length. The pulses at the output terminal are, of course, repetitive and remain at the same duty cycle without variation. By using a plurality of the flip-flops, each having respective inputs to the clock and clear terminals, a desired range of pitches can be generated.

7 Claims, 3 Drawing Figures

PULSE GENERATOR FOR AN ELECTRONIC MUSICAL INSTRUMENT

The present invention relates to a pulse generator for providing pulses of different duty cycles for musical purposes, especially for an electronic musical instrument, and is particularly concerned with an inexpensive arrangement for generating such pulses which is, at the same time, uniform at all pitches.

It is customary in electronic organs to generate square waves, or square pulses, for production of the organ tones with the square waves being modified by voicing circuits and the like in order to provide for the desired harmonic content. The adjustment of the harmonic content of square waves, or pulses, can be accomplished by adjusting the duty cycle thereof, which is to say, adjusting the duration of the individual pulses.

Previously, it has been difficult to provide for reliable adjustment of the duty cycle of the pulses, particularly when a plurality of pitches were to be provided for. Thus, it was not unusual to find that the duty cycle of the pulses provided would vary so much within a range of about eight semi-tones that the duty cycle had to be readjusted.

This was an undesirable situation because the variation in the duty cycle of the pulses brought about variation in the harmonic content of the pulses and, thus, changed the character of the organ voices.

According to the present invention, pulses of variable duty cycle are generated for musical purposes in a simple and direct manner and the duty cycle of the resulting pulses will not change as the pitch changes whereby there is no change in the harmonic content of the pulses and, accordingly, no change in the character of the resulting voice.

BRIEF SUMMARY OF THE INVENTION

According to the present invention, a "D" type flip-flop is employed for each pitch to be generated and has a logic 1 supplied to the data terminal. A train of substantially rectangular pulses, which may be square, of predetermined frequency are supplied to the clock terminal and other rectangular waves, or pulses, and which may also be square, of no lower frequency, are supplied to the clear terminal of the flip-flop.

The logic 1 at the data terminal is transferred to, say, the Q terminal of the flip-flop at the rising edge of the pulses supplied to the clock terminal when the clear terminal is high, and the said Q terminal then goes to zero on the next following transition at the clear terminal. The duty cycle of the output pulses will be controlled by the frequency of the waves, or pulses, supplied to the clear terminal and will vary downwardly from 50 percent duty cycle.

It is convenient to employ square waves, or pulses, for the clock and clear terminals because they can be derived from the tone generator system of the organ. For example, the lowest frequency waves usually encountered in electronic organs correspond to 16 foot or 32 foot voices and could be supplied to the clock terminal. The same, or higher frequency waves, or pulses, are supplied to the clear terminal and can also be derived from the tone generator.

In practice, as many flip-flops are employed as there are pitches to be generated with the clock terminals and the clear terminals being supplied with respective ranges of pitches and with the pitches in each range being spaced apart a semi-tone.

The exact nature of the present invention will become more clearly apparent upon reference to the following detailed specification taken in connection with the accompanying drawings in which.

DETAILED DESCRIPTION OF THE INVENTION

Figure 1:
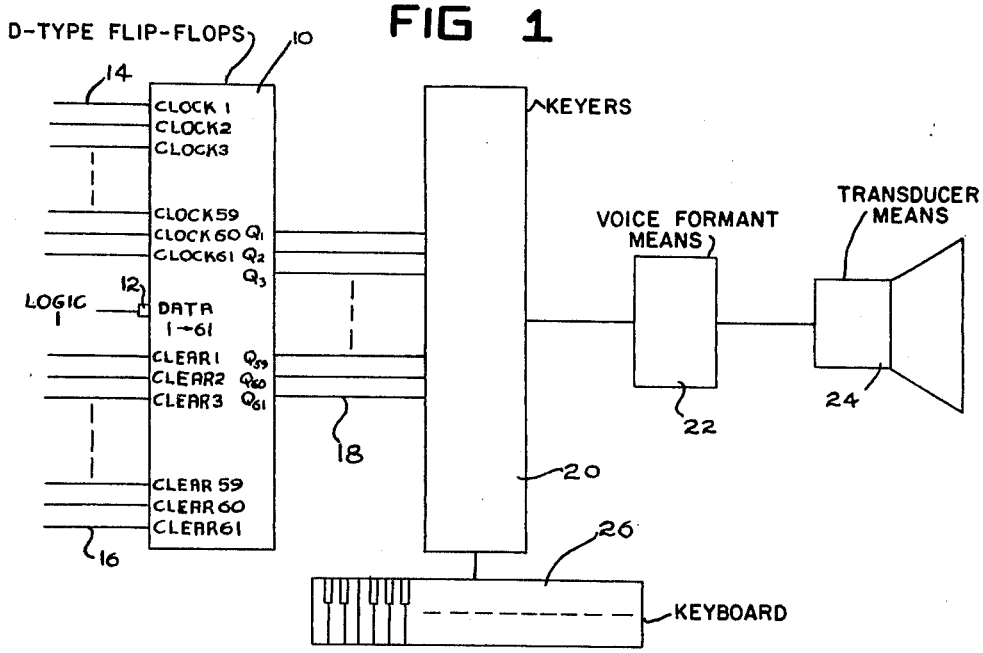
FIG. 1 is a schematic view showing the development of a plurality of pitches in respect of an electronic organ and the connection of the source of pitches to keyers, voice formant means and an electroacoustic transducer.

Referring to the drawings somewhat more in detail, the block indicated by reference numeral 10 represents a bank of D type flip-flops which may be, for example, 61 in number with each flip-flop corresponding to a key of, for example, the solo manual of an electronic organ. The flip-flops are supplied with data at a logic 1 level via a data terminal 12. Each of the flip-flops also has a clock terminal to which a wire 14 leading from a first source at a respective pitch is connected.

The pitches corresponding to wires 14 are selected from, for example, the 16 foot source of tone signals from the electronic organ tone generator. The 16 foot pitches connected to wires 14 might represent the lowest pitches developed within the organ although 32 foot pitches could be employed if so desired. The 61 pitches supplied to wires 14 are distributed in conformity with the semi-tones of the scale and it will be apparent that 61 pitches provide one more semi-tone than are encompassed within five octaves.

The flip-flops of unit 10 are each also provided with a clear terminal and wires 16 are connected to the clear terminals and lead to a second source which may be at higher frequency than the source connected to wires 14. The second source can also be taken from the organ tone generator source and may consist, for example, of one, two, four, eight or 16 foot pitches and which are arrived at by dividing down the oscillator output with the last division resulting in the 16 or 32 foot pitches for the clock terminals.

When an oscillator is the source for each pitch and is divided down, the second source is the same frequency as the first source, or an even multiple thereof. However, the primary source could be arranged to provide for further multiples of the first source frequency whereby the second source could include not only even multiples of the frequency of the first source but also odd multiples thereof.

Each of the 61 flip-flops in unit 10 also has a Q output terminal and to these Q output terminals there are connected the wires 18. The 61 wires 18 lead to respective keyers indicated by the block 20 and when the keyers are actuated, the tone signals pertaining thereto are conveyed via the keyers to the voice formant circuit means 22, and then to the electroacoustic transducer means 24.

The keyers are actuated by any suitable means from the keyboard represented at 26. The keyers are electronic and can be actuated directly by switches under the control of keys 26 or via any suitable circuitry provided for this purpose.

Figure 2:
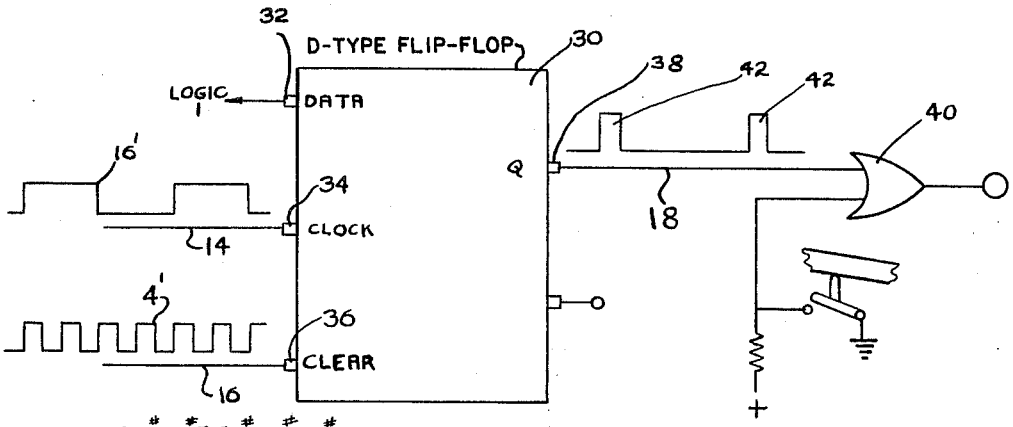
FIG. 2 shows a single pulse generating unit from FIG. 1 showing the generation of a single train of variable duty pulses.

FIG. 2 shows a single D type flip-flop 30 of which, as mentioned, there are 61 in block 10 of FIG. 1. In FIG. 2, flip-flop 30 has a data input terminal 32 held at logic 1 during operation, a clock terminal 34 connected to a respective one of wires 14 and a clear terminal 36 connected to a respective one of wires 16.

The flip-flop, furthermore, has a Q output terminal 38 connected to a respective one of wires 18 with wire 18 connected to one input terminal of an OR gate 40, representing a keyer, and the other input terminal of which leads to the circuit under control of keys 26. In the type of keyer illustrated, the line under the control of a playing key stays high until the key is depressed and then goes low whereby tone signals appear at the keyer output only when the respective key is depressed.

In FIG. 2, a 16 foot square wave is disclosed as being supplied to terminal 34 while a 4 foot square wave is provided to the input terminal 36.

The system operates as follows:

When data terminal 32 is high, a pulse 42 will be initiated at the Q output terminal 38 at the rising edge of a 16 foot pulse when the four foot pulse is high. Output pulse 42 will terminate on the next following transition of the 4 foot pulse when this pulse goes low and the next following output pulse 42 will then take place on the next rising transition of the 16 foot pulse.

It will be apparent that the duty cycle of pulses 42 is 12½ percent. The duty cycle of pulses 42 is controlled by the relationship between pulses 34 and 36 and will remain unchanged throughout the range of pitches generated by the several flip-flops.

It will also be apparent that the frequency of the input to the clear terminal of the flip-flop will be a whole multiple of the frequency of the input to the clock terminal. This whole multiple can be any number from one up to the highest frequency that is available.

The variation in the duty cycle of the output pulses permits ready selection of the harmonic content of the output pulses.

In the normal course of events, the supply to the clear terminal is at a higher frequency than the supply to the clock terminal and, thus, is taken off the divider chain closer to the oscillator than the supply to the clock terminal. There is, thus, some slight delay between the rise time of the pulse to the clear terminal and the pulse to the clock terminal which is of advantage because the clear terminal will always be at a high level on the rising transition of the pulse to the clock terminal. The delay in any case is probably not longer than 1/10 microsecond which is not discernable.

In case the clock and clear terminals are supplied from the same frequency source to obtain a 50 percent duty cycle output pulse, the input to the clock terminal could be slightly delayed by suitable circuitry.

As examples of the various duty cycles that can be obtained, assuming a given frequency F for the supply to the clock terminal; the following chart will show the duty cycles which obtain for the output pulses for each multiple of the clock terminal frequency that is supplied to the clear terminal:

| CLOCK TERMINAL FREQUENCY = | F | DUTY CYCLE OF OUTPUT PULSES |
|---|---|---|
| CLEAR TERMINAL FREQUENCY | 1F | 50.0% |
| | 2F | 25.0% |
| | 3F | 16⅔% |
| | 4F | 12.5 % |

-continued

| CLOCK TERMINAL FREQUENCY = | F | DUTY CYCLE OF OUTPUT PULSES |
|---|---|---|
| | 5F | 10.0% |
| | 8F | 6¼% |
| | 16F | 3⅛% |

As mentioned, all of the clear terminal frequencies are whole multiples of the clock terminal frequency and could be any whole multiple although, normally, the clear terminal frequency is a whole power of two times the clock terminal frequency because these frequencies are easily obtainable from a frequency divider chain.

It will be evident that the present invention provides for uniform harmonic content of the output signals over the entire range of pitches to be generated and that this advantage is easily obtainable by the practice of the present invention.

Figure 3:
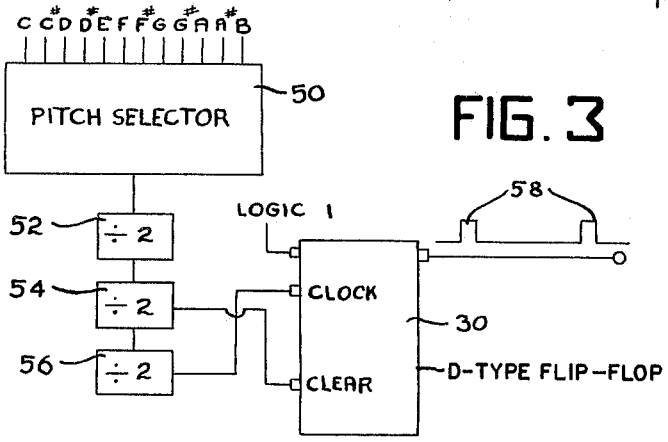
FIG. 3 shows the adaptation of the invention to a monophonic system for synthesizing tones, as for pedal tones, for example.

FIG. 3 shows at 50 a pitch selecter for supplying serially connected frequency dividers 52, 54 and 56. The output from divider 54 supplies the clear terminal of flip-flop 30, while the output from divider 56 supplies the clock terminal of flip-flop 30. The duty cycle of output pulses 58 is, in this case 25% because the clear pulses are at twice the frequency of the clock pulses.

Modifications may be made within the scope of the appended claims.

What is claimed is:

1. In a method of generating musical tones of predetermined harmonic content which comprises; supplying a first train of rectangular pulses at audible frequency and a second train of rectangular pulses at a frequency which is a whole multiple of the frequency of said first pulse train, each said supply having a first voltage state during each pulse thereof and a second voltage state in the interval between successive pulses and each pulse having leading and trailing edges, initiating a signal pulse substantially at one of the leading and trailing edges of a said first pulse when said second supply is in one of said states thereof, terminating each signal pulse at the next following change of state of the respective said second supply, and converting the signal pulses to sound.

2. A method according to claim 1 in which the said edge of said first pulse is the leading edge thereof and said one state of said second supply is the said first voltage state thereof.

3. A method according to claim 1 in which said second pulses are supplied at a frequency which is equal to the frequency of supply of said first pulses multiplied by a whole number.

4. In a system for generating rectangular pulses of selected duty cycle which will produce musical tones of a predetermined harmonic content when converted to sound; D type flip-flop means having data, clock, clear and output terminal means, said data terminal means adapted to be held at logic 1, means for supplying a train of first rectangular pulses at a first predetermined frequency to said clock terminal means, means for supplying a train of second rectangular pulses at a second predetermined frequency which is a whole multiple of said first frequency to said clear terminal means, means for withdrawing rectangular pulses at said first frequency and having a duty cycle of less than 100 percent from said output terminal means, and transducer means connected to said output terminal means for converting said withdrawn pulses to sound.

5. A system according to claim 4 in which the percent duty cycle of said rectangular pulses is equal to 50 times said first frequency divided by said second frequency.

6. A system according to claim 4 which includes a plurality of said flip-flops, said first pulses supplied to the clock terminals of the respective flip-flops having frequencies which are equal to the frequencies of the semitones of the musical scale, trains of second pulses having frequencies which are equal to the frequencies of the semitones of the musical scale multiplied by a whole number and connected to the respective clear terminals of said flip-flops, said rectangular pulses conforming in frequency to the frequency of said train of first pulses but differing in duty cycle therefrom.

7. A system according to claim 4 in which said means for supplying trains of pulses comprises; a frequency selecter having an output side and adapted for supplying pulses at a selected frequency to the said output side, a series of frequency dividers connected to the output side of said selecter, said clear terminal being connected to the output side of one frequency divider and said clock terminal being connected to the output side of a frequency divider which is connected in following relation to said one frequency divider.

* * * * *